US008264532B2

(12) United States Patent
Aivalis et al.

(10) Patent No.: US 8,264,532 B2
(45) Date of Patent: Sep. 11, 2012

(54) THROUGH-MILL WELLBORE OPTICAL INSPECTION AND REMEDIATION APPARATUS AND METHODOLOGY

(75) Inventors: James G. Aivalis, Houston, TX (US); Christopher Prusiecki, Houston, TX (US)

(73) Assignee: ThruBit B.V. (NL)

( * ) Notice: Subject to any disclaimer, the term of this patent is extended or adjusted under 35 U.S.C. 154(b) by 1433 days.

(21) Appl. No.: 11/836,172

(22) Filed: Aug. 9, 2007

(65) Prior Publication Data

US 2009/0038391 A1 Feb. 12, 2009

(51) Int. Cl.
*A61B 1/06* (2006.01)

(52) U.S. Cl. ..... 348/85; 340/854.8; 175/257; 175/133; 175/393

(58) Field of Classification Search ..... 348/85; 340/854.8; 175/57
See application file for complete search history.

(56) References Cited

U.S. PATENT DOCUMENTS

| | | | | |
|---|---|---|---|---|
| 4,800,104 | A | 1/1989 | Cruickshank | |
| 5,244,050 | A * | 9/1993 | Estes | 175/393 |
| 5,285,008 | A * | 2/1994 | Sas-Jaworsky et al. | 174/47 |
| 5,419,188 | A | 5/1995 | Rademaker | |
| 5,521,592 | A * | 5/1996 | Veneruso | 340/854.8 |
| 6,041,860 | A * | 3/2000 | Nazzal et al. | 166/250.01 |
| 6,269,891 | B1 | 8/2001 | Runia | |
| 6,443,247 | B1 | 9/2002 | Wardley | |
| 6,527,513 | B1 | 3/2003 | Van Drentham-Susman et al. | |
| 6,561,278 | B2 | 5/2003 | Restarick et al. | |
| 6,663,453 | B2 * | 12/2003 | Quigley et al. | 441/133 |
| 6,702,041 | B2 | 3/2004 | Runia | |
| 7,134,493 | B2 | 11/2006 | Runia | |
| 7,140,454 | B2 * | 11/2006 | Runia | 175/57 |
| 7,188,672 | B2 | 3/2007 | Berkheimer et al. | |
| 7,281,592 | B2 | 10/2007 | Runia et al. | |
| 7,287,609 | B2 * | 10/2007 | Runia et al. | 175/257 |
| 7,296,639 | B2 * | 11/2007 | Millar et al. | 175/57 |
| 2004/0074639 | A1 | 4/2004 | Runia | |
| 2004/0118611 | A1 | 6/2004 | Runia et al. | |
| 2005/0016302 | A1 | 1/2005 | Simpson et al. | |
| 2005/0029017 | A1 | 2/2005 | Berkheimer et al. | |
| 2006/0000619 | A1 | 1/2006 | Borst et al. | |
| 2006/0118298 | A1 | 6/2006 | Millar et al. | |
| 2006/0266512 | A1 | 11/2006 | Lohbeck | |

(Continued)

OTHER PUBLICATIONS

Runia ("Through Bit Logging: A New Method to Acquire Log Data, and a First Step on the Road to Through Bore Drilling," SPWLA 45th Annual Logging Symposium, Jun. 6-9, 2004, pp. 1-8).*

(Continued)

*Primary Examiner* — Tammy Nguyen
(74) *Attorney, Agent, or Firm* — Chamberlain Hrdlicka

(57) ABSTRACT

An optical inspection instrument includes a housing configured to move along the interior of a pipe string in a wellbore. The pipe has a cutting structure at its bottom end. The instrument includes a probe extending from a bottom end of the housing. The probe has an output from a light source and a light input to a video camera. The probe has a diameter selected to enable extension through an opening in the cutting structure. A method for inspecting a wellbore includes moving an instrument through an interior of a pipe string in the wellbore. The pipe has a cutting tool at its lower end. At least part of the instrument is moved outside the bottom end of the pipe through a port in the cutting tool. Optically transparent fluid is moved into the wellbore proximate an end of the instrument outside the pipe string. Objects proximate the fluid are inspected.

24 Claims, 7 Drawing Sheets

U.S. PATENT DOCUMENTS

| | | | |
|---|---|---|---|
| 2007/0068677 | A1 | 3/2007 | Angman et al. |
| 2008/0066905 | A1 | 3/2008 | Aivalis et al. |
| 2008/0066961 | A1 | 3/2008 | Aivalis et al. |
| 2008/0156477 | A1 | 7/2008 | Aivalis et al. |
| 2008/0173481 | A1 | 7/2008 | Menezes et al. |
| 2009/0038391 | A1 | 2/2009 | Aivalis et al. |

OTHER PUBLICATIONS

Matula, Chuck, "Lower Risk by Logging Through the Bit," Exploration and Production Magazine, Jan. 29, 2009, pp. 1-2.

Runia, John, et al., "Through Bit Logging: Applications in Difficult Wells, Offshore North Sea," SPE/IADC Drilling Conference, Feb. 23-25, 2005, pp. 1-8.

Runia, John, et al., "Through Bit Logging: A New Method to Acquire Log Data, and a First Step on the Road to Through Bore Drilling," SPWLA 45th Annual Logging Symposium, Jun. 6-9, 2004, pp. 1-8.

Mahony, James, "Through-Bit Technology May Brighten the Outlook for Tough Logging Conditions," New Technology Magazine, Sep. 2004, pp. 1-3.

* cited by examiner

THROUGH-MILL WELLBORE OPTICAL INSPECTION AND REMEDIATION APPARATUS AND METHODOLOGY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of subsurface wellbore inspection using video. More specifically, the invention relates to apparatus and methods for video inspection and remediation during wellbore milling operations.

2. Background Art

Wellbore operations for wellbores drilled through the Earth's subsurface include milling. Milling is used for, among other purposes, providing a suitable upper surface to tools and equipment that have become lodged or placed in the wellbore so that such tools and equipment can be inspected, retrieved, and/or repaired while in the wellbore or retrieved from the wellbore using a retrieval tool or a repair device. Milling is also used to cut windows though the wall of pipe or casing disposed in the wellbore so that "lateral" wellbores can be drilled and "tied back" to the wellbore through which the window was milled. Milling is typically performed by coupling a suitable milling tool to the end of a pipe string (drill string, coil tubing or work string) that is then inserted into the wellbore to the place where the milling is to be performed. The drill string or pipe string is typically formed by threadedly coupling pipe segments ("joints" or "stands") together end to end or with a continuous pipe conduit such as coil tubing. The milling tool may be rotated by rotating the pipe string, or by pumping fluid through an hydraulic motor coupled in the lower portion of the pipe string.

The success of milling operations is dependent to a large degree on the skill of the mill operator. This is because the mill operator must make inferences about the condition of the device being milled and the milling tool only from: (i) surface measurements of torque applied to the drill string or work string to which the mill is coupled; (ii) axial loading applied to the mill inferred from surface measurements of the suspended weight of the drill string or work string; and (iii) pressure of fluid being pumped through the drill string or work string.

In order for the wellbore operator to use the milled casing window or to attempt to retrieve or repair the milled tools and equipment, it is necessary to remove the drill string or work string from the wellbore, and to then attempt to insert tools and equipment through the milled window or to attempt to retrieve/repair the lodged tools and equipment by coupling suitable devices to the end of the drill string or work string. The drill string or work string is then reinserted into the wellbore with the suitable devices thereon. If the milling operation performed previously is incomplete, the wellbore operator will learn of such condition only when the devices fail to accomplish their purpose. It is then necessary for the wellbore operator to retrieve the drill string or work string, and resume milling operations. Repeated "tripping" the drill string or work string can be time consuming and expensive.

The speed at which milling operations proceed may depend on a number of conditions within the wellbore, one of which is the condition of the milling tool. If milling operations proceed at a slower rate than expected, or materially slow down during the course of milling operations, the wellbore operator may reasonably conclude that the milling tool is becoming worn and needs to be replaced. Replacing the milling tool requires tripping the pipe string. If it is determined that the milling tool was not worn, then the pipe string trip will have proven to be unnecessary.

It is desirable to have a device for inspecting a milled device within a wellbore and for inspecting a milling tool while it is disposed in the wellbore so that unnecessary pipe tripping can be reduced.

SUMMARY OF THE INVENTION

A wellbore optical inspection instrument according to one aspect of the invention includes a housing configured to move along the interior of a pipe string disposed in a wellbore. The pipe string has a cutting structure at a bottom end thereof. The instrument includes a probe extending from a bottom longitudinal end of the housing. The probe has therein an output from a light source and a light input to a video camera. The probe has a diameter selected to enable extension thereof through an opening in the cutting structure.

A method for inspecting a wellbore according to another aspect of the invention includes moving an inspection instrument through an interior of a pipe string inserted into the wellbore. The pipe string has a cutting tool at a lower end thereof. At least part of the instrument is moved longitudinally outside the bottom end of the pipe string through a port in the cutting tool. Optically transparent fluid is moved into the wellbore proximate an end of the instrument outside the pipe string. At least one object proximate the optically transparent fluid is optically inspected.

Other aspects and advantages of the invention will be apparent from the following description and the appended claims.

DETAILED DESCRIPTION

Figure 1:
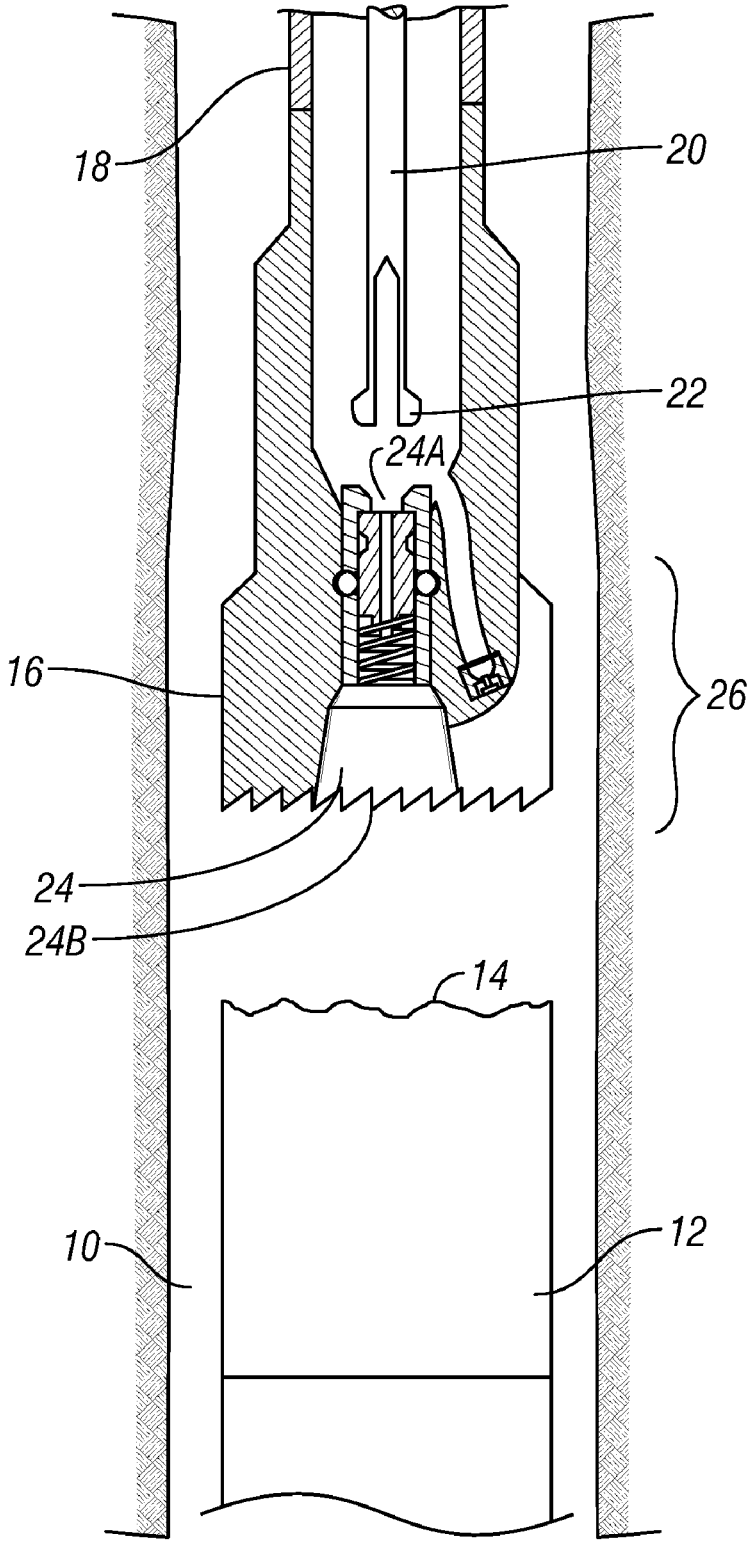
FIG. 1 shows an example mill in a wellbore having a closeable passage, and a release tool to open the passage.

FIG. 1 shows a mill 16 coupled to the lower end of a pipe string 18. The pipe string 18 may be disposed in a wellbore 10 drilled through the Earth's subsurface. The pipe string 18 may be inserted into and withdrawn from the wellbore 10 by a drilling rig, workover rig or similar hoisting apparatus (not shown in FIG. 1) known in the art and disposed at the Earth's surface. In the example shown in FIG. 1, the mill 16 may be used to produce a suitable surface to retrieve a previously lost portion 12 of a pipe string or other device lost in the wellbore 10. For example, if a segment ("joint") of drill pipe breaks because of excessive loading or other cause, the uppermost end surface of the lost portion 12 may have an irregular surface 14. The irregular surface 14 may be unsuitable for engagement by a retrieval tool (not shown in FIG. 1), such as a "grapple" or "overshot" of types typically conveyed into and out of the wellbore 10 by the pipe string 18. Accordingly, the mill 16 is rotated and longitudinally biased against the irregular surface 14 to machine or cut the irregular surface 14 until it becomes suitable for engagement by a retrieval tool (not shown).

In the present example, the mill 16 includes a passage 24A through which one or more tools (not shown) may freely pass from inside the pipe string 18 to below the bottom of the mill 16. Passage in the present example may be possible after a closure element 24 is removed from the passage 24A. The closure element 24 is ordinarily disposed within the passage 24A when the mill 16 and pipe string 18 are initially inserted into the wellbore 10. Typically the closure element 24 will include a mill 24B surface at the bottom thereof to provide additional milling tool area for machining or cutting the irregular surface 14. The closure element 24 may include a releasable latch 26 (explained in more detail below with reference to FIG. 1A) that engages the body of the mill 16 to hold the closure element 24 in place in the passage 24A during milling operations. A release tool 22 may be disposed at the bottom end of a tool string 20. The tool string 20 may include one or more devices (explained further below) for optical inspection of the irregular surface 14 and the working face of the mill 16 when the tool string 20 is moved through the passage 24A and into the wellbore 10 below the bottom of the mill 16.

The tool string 20 may be moved through the interior of the pipe string by one of a number of different devices, including "wireline" (armored electrical cable); "slickline" (smooth surface steel line with no electrical conductors); coiled tubing or the like. Each of the foregoing, while not a limit on the scope of the invention, has the advantage of being able to be moved into and out of the wellbore relatively quickly, as contrasted with the time required to insert and withdraw the pipe string 18. Such insertion and withdrawal required threadedly connecting and disconnecting segments of the pipe string from each other, as is known in the art. A particular advantage of wireline conveyance is that it provides an electrical path for powering certain instruments (not shown FIG. 1) in the tool string 20 and a relatively high bandwidth signal communication channel to return video or similar signals to the Earth's surface for viewing and interpretation.

Figure 1A:
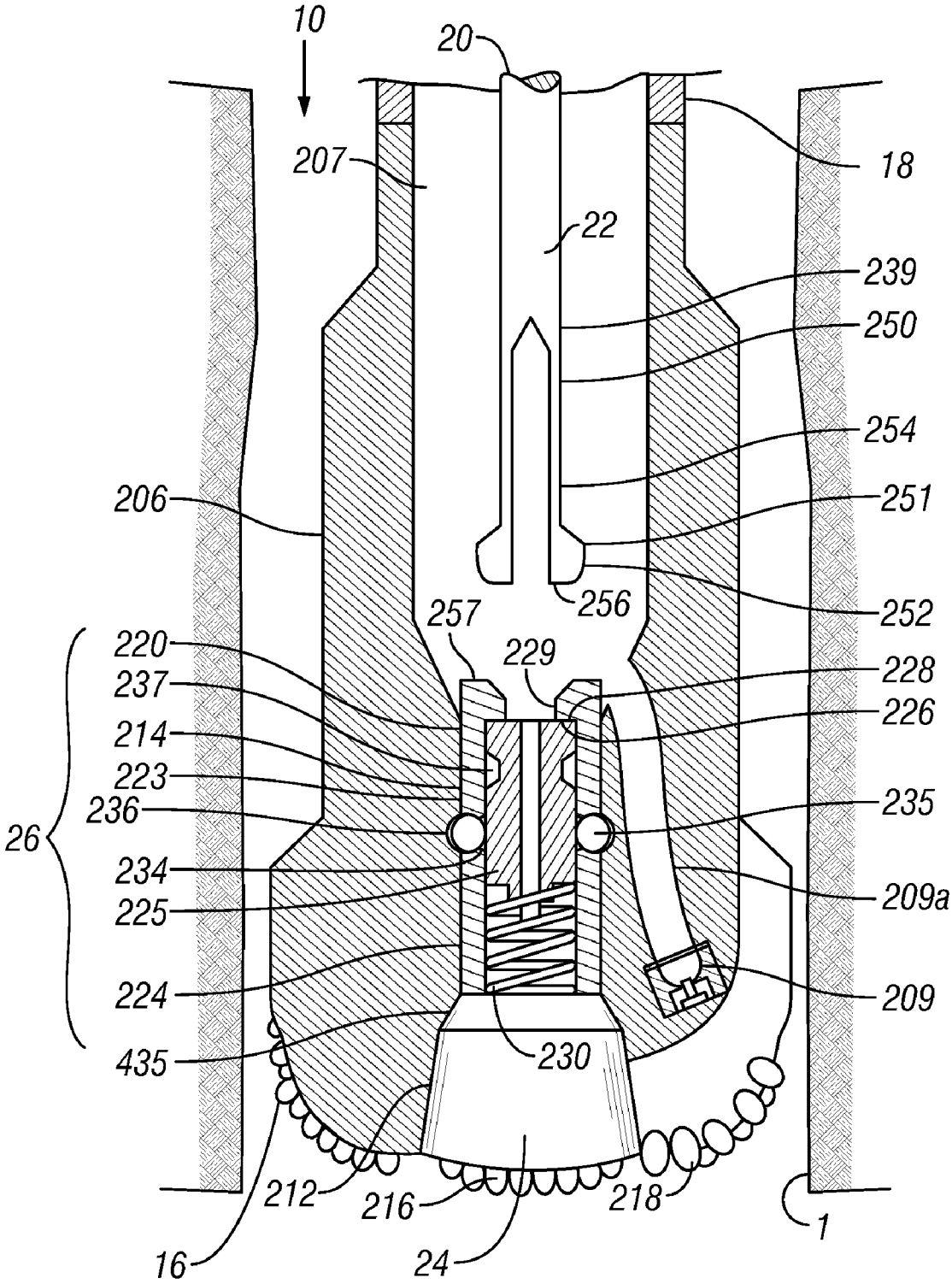
FIG. 1A shows a passage and closure element with latch device in the mill in more detail.

Referring to FIG. 1A, a longitudinal cross-section of the mill 16 is shown, showing in more detail the latch 26. The mill body 206 of the mill 16 has a central longitudinal passage 20 for movement of the tool string 22 from the interior 207 of the pipe string 18 into the wellbore 10 external to the mill 16, as will be explained in more detail below. The mill 16 may include nozzles 209 arranged in the mill body 206. Only one nozzle with an insert is shown for the sake of clarity. The nozzle 209 is connected to the passageway 20 via a nozzle channel 209*a*.

The mill 16 includes the removable closure element 24 which is shown in FIG. 1A in its closed position with respect to the longitudinal passage 420. The closure element 24 of this example includes a central insert section 212 and a latching section 214. The insert section 212 is provided with cutting elements 216 at its front end, wherein the cutting elements are arranged so as to form, in the closed position, a joint mill face together with the cutting element 218 at the lower end of the mill body 206. The insert section 212 can also be provided with nozzles (not shown). Further, the insert section 212 and the cooperating surface of the mill body 206 are shaped suitably so as to allow transmission of milling torque from the mill body 206 to the insert section 212. Such shape may be in the form of splines or cooperating polygonal surfaces, for example.

The latching section 214, which is fixedly attached to the interior end of the insert section 212, can have substantially cylindrical shape and extend into a central longitudinal bore 220 in the mill body 206 with narrow clearance. The bore 220 forms part of the passage (24A in FIG. 1).

The closure element 24 is removably attached to the mill body 206 by the latching section 214. The latching section 214 of the closure element 24 comprises a substantially cylindrical outer sleeve 223 which extends with narrow clearance along the bore 220. A sealing ring 224 can be arranged in a groove around the circumference of the outer sleeve 223, to prevent fluid communication along the outer surface of the latching section 214. Connected to the lower end of the sleeve 223 is the insert section 212. The latching section 214 further comprises an inner sleeve 225, which slidingly fits into the outer sleeve 223. The inner sleeve 225 is biased with its upper end 226 against an inward shoulder 228 formed by an inward rim 229 near the upper end of the sleeve 223. The biasing force is exerted by a partly compressed helical spring 230, which pushes the inner sleeve 225 away from the insert section 212. At its lower end the inner sleeve 225 is provided with an annular recess which is arranged to retain the upper part of spring 230.

The outer sleeve 223 is provided with recesses 234 wherein locking balls 235 are arranged. A locking ball 235 has a larger diameter than the thickness of the wall of the sleeve 223, and each recess 234 is arranged to hold the respective ball 235 loosely so that it can move a limited distance radially in and out of the sleeve 223. Two locking balls 235 are shown in the drawing, however, more locking balls can be used in other implementations.

In the closed position as shown in FIG. 1A the locking balls 235 are pushed radially outwardly by the inner sleeve 225, and register with the annular recess 236 arranged in the bit body 206 around the bore 220. In this way the closure element 435 is locked to the drilling bit 410. The inner sleeve 225 is further provided with an annular recess 237, which is, in the closed position, longitudinally displaced with respect to the recess 236 in the direction of the pipe string 18.

The inward rim 229 is arranged to cooperate with a connection means 239 at the lower end of the releasing tool 22. The connection means 239 is provided with a number of legs 250 extending longitudinally downwardly from the circumference of the releasing tool 22. For the sake of clarity only two legs 250 are shown, but it will be clear that more legs can be arranged. Each leg 250 at its lower end is provided with a dog 251, such that the outer diameter defined by the dogs 251 at position 252 exceeds the outer diameter defined by the legs 250 at position 254, and also exceeds the inner diameter of the rim 229. Further, the inner diameter of the rim 229 is preferably larger or about equal to the outer diameter defined by the legs 250 at position 254, and the inner diameter of the outer sleeve 223 is smaller or approximately equal to the outer diameter defined by the dogs 251 at position 252. Further, the legs 250 are arranged so that they are inwardly elastically deformable. The outer, lower edges 256 of the dogs 251 and the upper inner circumference 257 of the rim 229 are beveled. Using the above described closure element and releasing tool, it is possible to repeatedly open and close the passage (24A in FIG. 1) to enable moving the tool string 20 out of the bottom of the mill 16 as required.

In one example, the release tool 22 may be affixed to the lower end of the tool string 20 and the tool string 20 is inserted into the pipe string until the release tool 22 engages the closure element 24. The closure element 24 may then be removed from the mill 16 by withdrawing the tool string 20 from the interior of the pipe string 18. In another example, the tool string 20 may be further extended into the pipe string 18 after release of the latch 26, so that the closure element 24 and the tool string attached thereabove (using release tool 22) are moved into the wellbore 10 below the mill 16.

Figure 2:
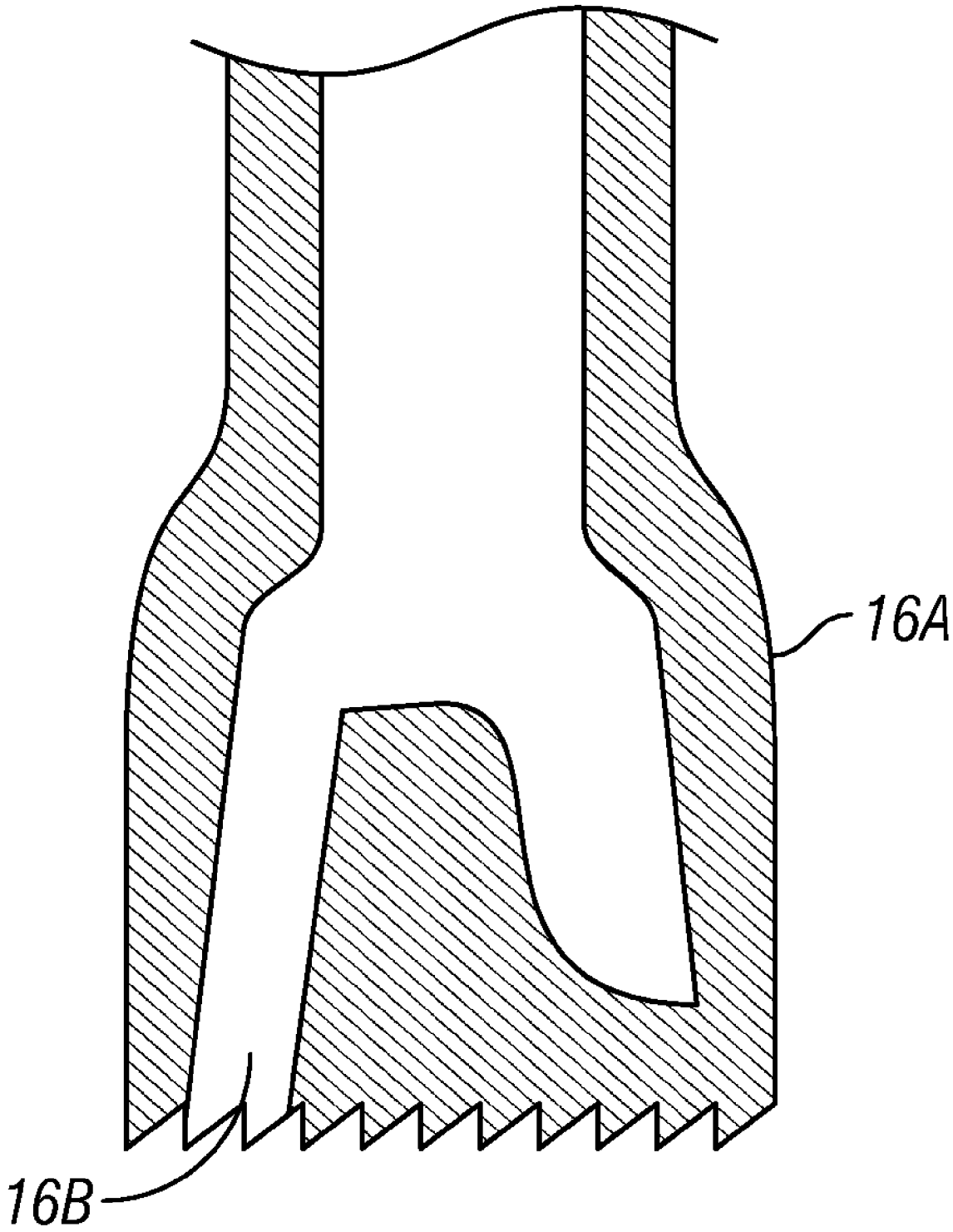
FIG. 2 shows another example of a mill.

Referring to FIG. 2, a different example of the mill 16A may include an open passage 16B arranged such that the tool string (20 in FIG. 1) may exit the mill 16A directly without the need to remove a closure element. Preferably, the example of FIG. 2 with an open passage 16B has the passage 16B disposed away from the axial centerline of the mill 16A so that the entire irregular surface (14 in FIG. 1) may be milled.

Figure 3:
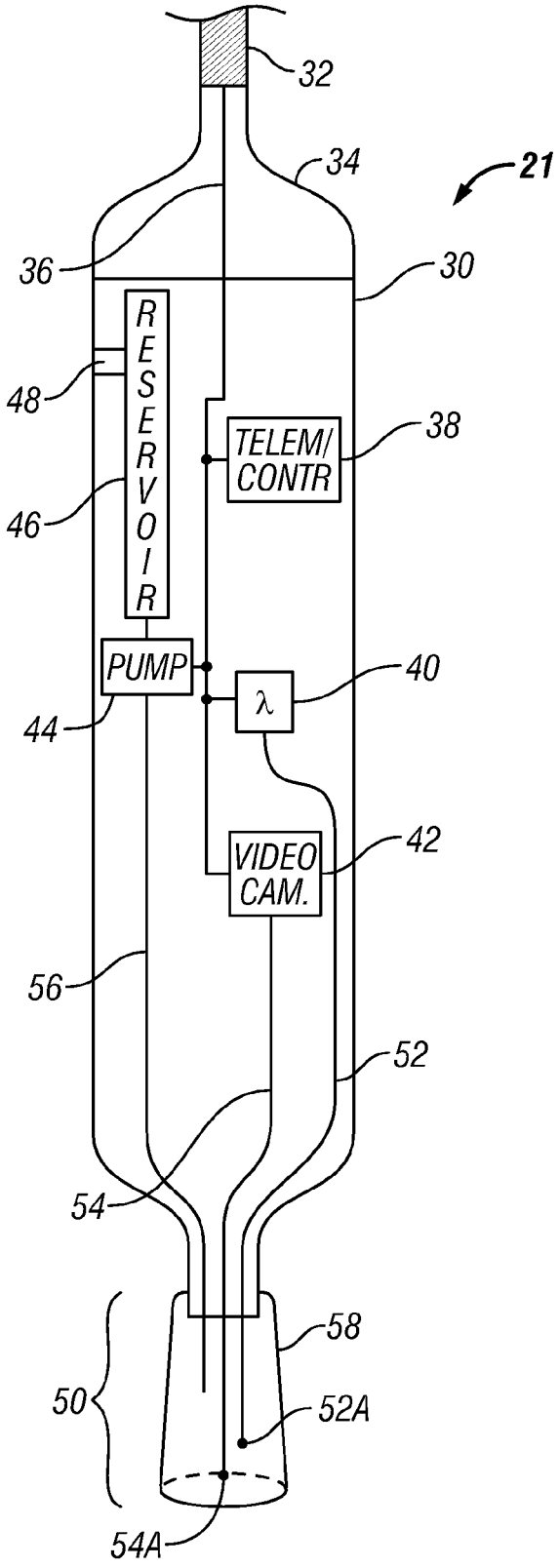
FIG. 3 shows one example of an optical inspection apparatus in the tool string.

One example of an optical inspection instrument 21 disposed on or forming all or part of the tool string (20 in FIG. 1) is shown in FIG. 3. The optical inspection instrument 21 includes a generally elongated cylindrical, pressure resistant housing 30 that can move along the interior of the pipe string (18 in FIG. 1). The housing 30 in this example may be terminated at its upper end by a cable head 34 of any type known in the art to make electrical and mechanical connection to a wireline 32. The wireline 32 consists of one or more helically wound layers of armor wire on the exterior and one or more insulated electrical conductors 36 disposed inside the armor wires. The wireline 32 may be conveyed into and out of the wellbore (10 in FIG. 1) by a winch or similar conveyance well known in the art. Functional components of the instrument 21 disposed inside the housing 30 can include a telemetry and control unit 38 which may be a microprocessor based controller with associated data and command signal telemetry in signal communication with the one or more electrical conductors 36. The telemetry and control unit 38 accepts command signals from the Earth's surface to govern operation of other components inside the housing 30. For example, at the time optical images of the interior of the wellbore are desired, a pump 44 may be activated to discharge a viscous, optically transparent fluid stored in a reservoir 46 into the interior of a probe 50 extending below the bottom of the housing 30. The transparent fluid is preferably similar in density to the fluid in the wellbore (10 in FIG. 1) to avoid changing the hydrostatic pressure in the wellbore (10 in FIG. 1), and to avoid sinking or floating of the transparent fluid within the wellbore fluid when the transparent fluid is discharged. The transparent fluid also preferably has a viscosity sufficient to prevent rapid diffusion in the wellbore fluid, that is, the transparent fluid should remain in the form of a "pill" for an amount of time sufficient to perform optical inspection of the wellbore (10 in FIG. 1) and/or the mill (16 in FIG. 1). The reservoir 46 is preferably compensated to maintain its pressure at least equal to the hydrostatic pressure inside the pipe string (18 in FIG. 1) by a pressure compensator 48. The pressure compensator 48 can be of any type known in the art for communicating fluid pressure while preventing fluid exchange or movement across a barrier. Such barrier may be, for example a piston in a cylinder open at both longitudinal ends or an elastomer bladder, as will be appreciated by those skilled in the art. The type of pressure compensator is not a limit on the scope of the invention.

The transparent fluid discharged by the pump 44 is moved through a conduit 56 having an outlet inside a sheath 58 extending longitudinally from the bottom of the housing 30 so that the fluid fills the interior of the sheath 58 around the probe 50. The sheath 58 may be made from elastomer, plastic or similar material that can conform to the irregular surface (14 in FIG. 1) upon application of a certain amount of longitudinal force. The sheath 58 contains the transparent fluid therein to enable optical inspection of, for example, the irregular surface (14 in FIG. 1) with a relatively small volume of transparent fluid. It will be appreciated by those skilled in the art that a selected contiguous volume or "pill" of optically transparent fluid may be pumped through the pipe string 18 from the Earth's surface to just below the mill (16 in FIG. 1) to enable optical inspection. The arrangement shown in FIG. 3 for transporting and discharging optically transparent fluid may provide the advantage of more certainty as to the placement of such optically transparent fluid, as well as substantially reducing the necessary volume thereof.

The housing 30 also includes therein a light source 40 such as a light emitting diode or other light source. Output form the light source 40 may be conducted into the probe 50 over an optical fiber 52. The optical fiber 52 may terminate at the distal end from the light source 40 in a suitable lens 52A to provide a selected spatial distribution of light from the source 40. A video camera 42 may be disposed in the housing 30 and accept at its optical input light refracted into a suitable lens 54A at the end of an optical fiber 54 disposed in the probe 50. The camera fiber 54 may extend to the optical input to the camera 42. Thus, the interior of the probe 50, and any object in contact with the end of the probe 50, may be illuminated and optically inspected. Video signals from the camera 42 may be applied to signal telemetry along the wireline 32 either directly or by telemetry formatting in the controller 38. Alternatively, the video signals may be stored within the instrument 21 in a suitable data storage device (not shown) associated with the controller 38 for interrogation when the instrument 21 is removed from the pipe string (18 in FIG. 1).

The configuration of probe 50 shown in FIG. 3 in which light from the source 40 is conducted into the probe 50 through an optical fiber 52, and where reflected and/or refracted light is returned to the camera 42 through an optical fiber 54 may provide the advantage of reducing the necessary diameter of the probe 50. In such configuration, it maybe possible for the probe to be small enough diameter to enable extension thereof through the bottom of the tool string (20 in FIG. 1) through a suitable opening therein.

In using the instrument 21 shown in FIG. 3, for example, when it is desirable to inspect the irregular surface (14 in FIG. 1), the instrument 21 may be inserted into the pipe string (18 in FIG. 1) at the Earth's surface and lowered to the depth of the mill (16 in FIG. 1). If a closure element is used, it may be removed as explained with reference to FIG. 1A. If a mill such as shown in FIG. 2 is used, the instrument 21 may be lowered through the passage (16B in FIG. 2) until the probe 50 contacts the irregular surface (14 in FIG. 1). The pump 44 may be activated to fill the interior of the probe 50 with the optically transparent fluid. The light source 40 and camera 42 may then be activated. Images of the irregular surface (14 in FIG. 1) may be viewed on suitable equipment (not shown) at the surface and interpreted to determine the condition of the irregular surface (14 in FIG. 1). If further milling is required, the instrument 21 may be retrieved from within the pipe string (18 in FIG. 1) and milling may be resumed. In examples where the mill includes the closure element (24A in FIG. 1) as explained with reference to FIG. 1A, the closure element can be replaced in the mill (16 in FIG. 1) when the instrument 21 is withdrawn through the passage (24 in FIG. 1) in the mill (16 in FIG. 1).

Figure 4:
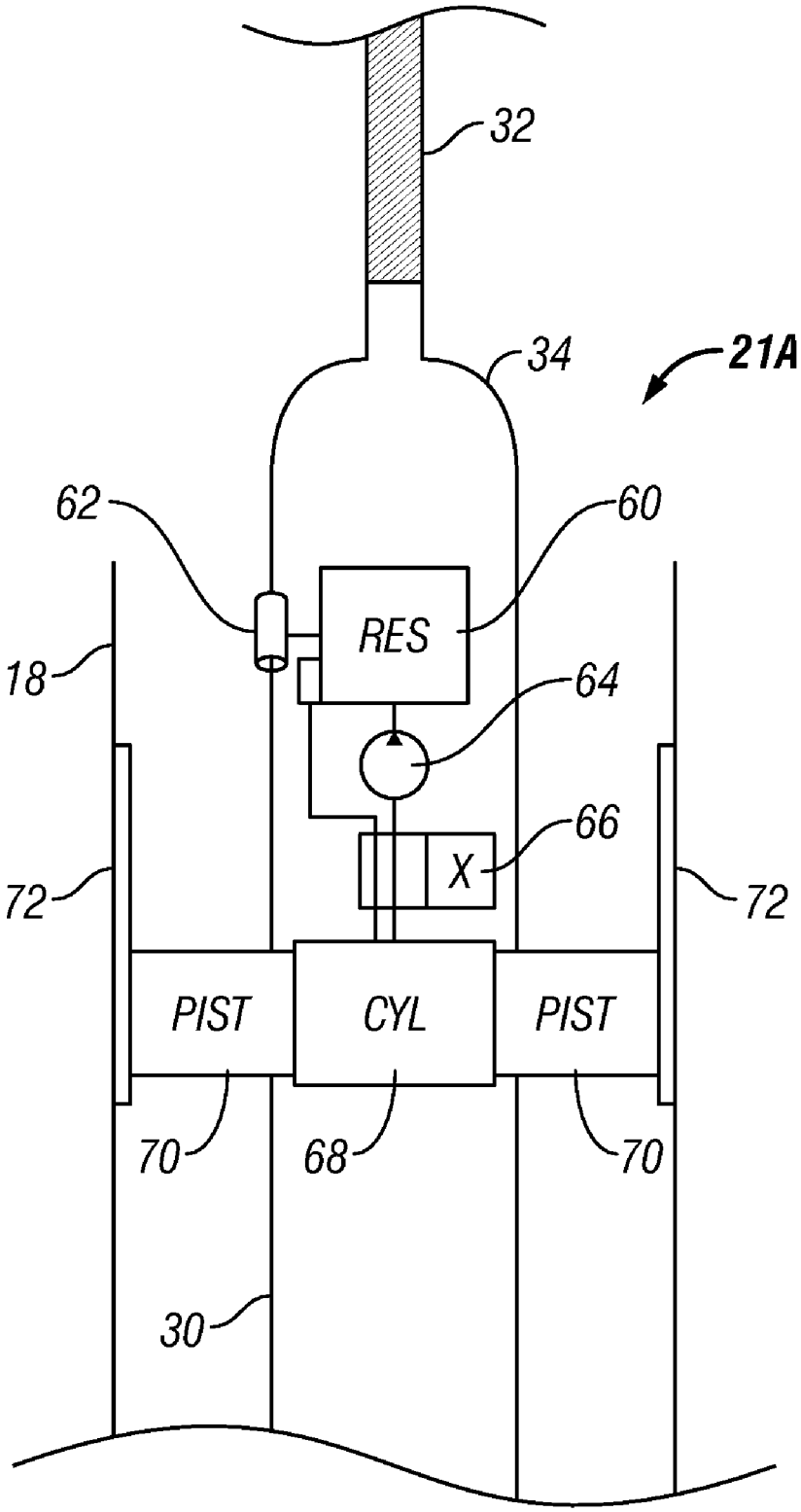
FIG. 4 shows an example of a device to fix the axial position of the tool string in the wellbore.

In other examples, and referring to FIG. 4, the instrument 21A may be configured to perform additional well intervention operations, such as milling, within the wellbore (10 in FIG. 1). In order to perform such additional intervention operations, it may be desirable to fix the axial position of the instrument 21A within the wellbore (10 in FIG. 1). In the present example, such axial position maintenance may be obtained by locking the instrument 21A within the lower end of the pipe string 18, while the lower end of the instrument 21A is extended through the passage (24 in FIG. 1 or 16B in FIG. 2) in the mill (16 in FIG. 1 or 16A in FIG. 2). A device shown in FIG. 4 may provide such functionality. A reservoir 60 including therein hydraulic fluid may be disposed inside the housing 30. The reservoir 60 is preferably compensated to maintain its pressure at least equal to the hydrostatic pressure inside the pipe string 18 by a pressure compensator 62. The pressure compensator 62 can be of any type known in the art for communicating fluid pressure while preventing fluid exchange or movement across a barrier. Such barrier may be, for example a piston in a cylinder open at both longitudinal ends or an elastomer bladder, as will be appreciated by those skilled in the art. The type of pressure compensator is not a limit on the scope of the invention. A pump 60 (typically under control of the controller 38 in FIG. 3) moves fluid from the reservoir 60 through a two way valve 66 into the interior of a cylinder 68 disposed in the housing 30. The two way valve 66 may be configured to discharge fluid under pressure into the cylinder either to extend or retract pistons 70 disposed on opposed longitudinal ends of the cylinder 68. The two way valve 66 may be a solenoid operated valve under the control of the controller (38 in FIG. 3). The external longitudinal end of each piston 70 is coupled to a pad or shoe 72. Thus, when the pistons 70 are extended from the cylinder 68 under pressure, the shoes 72 contact the interior of the pipe string 18 so as to frictionally retain the axial position of the instrument 21A within the pipe string 18. It will be appreciated by those skilled in the art that the device shown in FIG. 4 can be configured to retain the instrument 21A in axial position within the wellbore (10 in FIG. 1) below the mill (16 in FIG. 1) by pressing the shoes 72 against the wellbore wall. The configuration shown in FIG. 4 has the advantage of requiring smaller sizes of shoe, piston and cylinder to perform the axial position maintenance than a similar device configured to be position within the wellbore.

Figure 5:
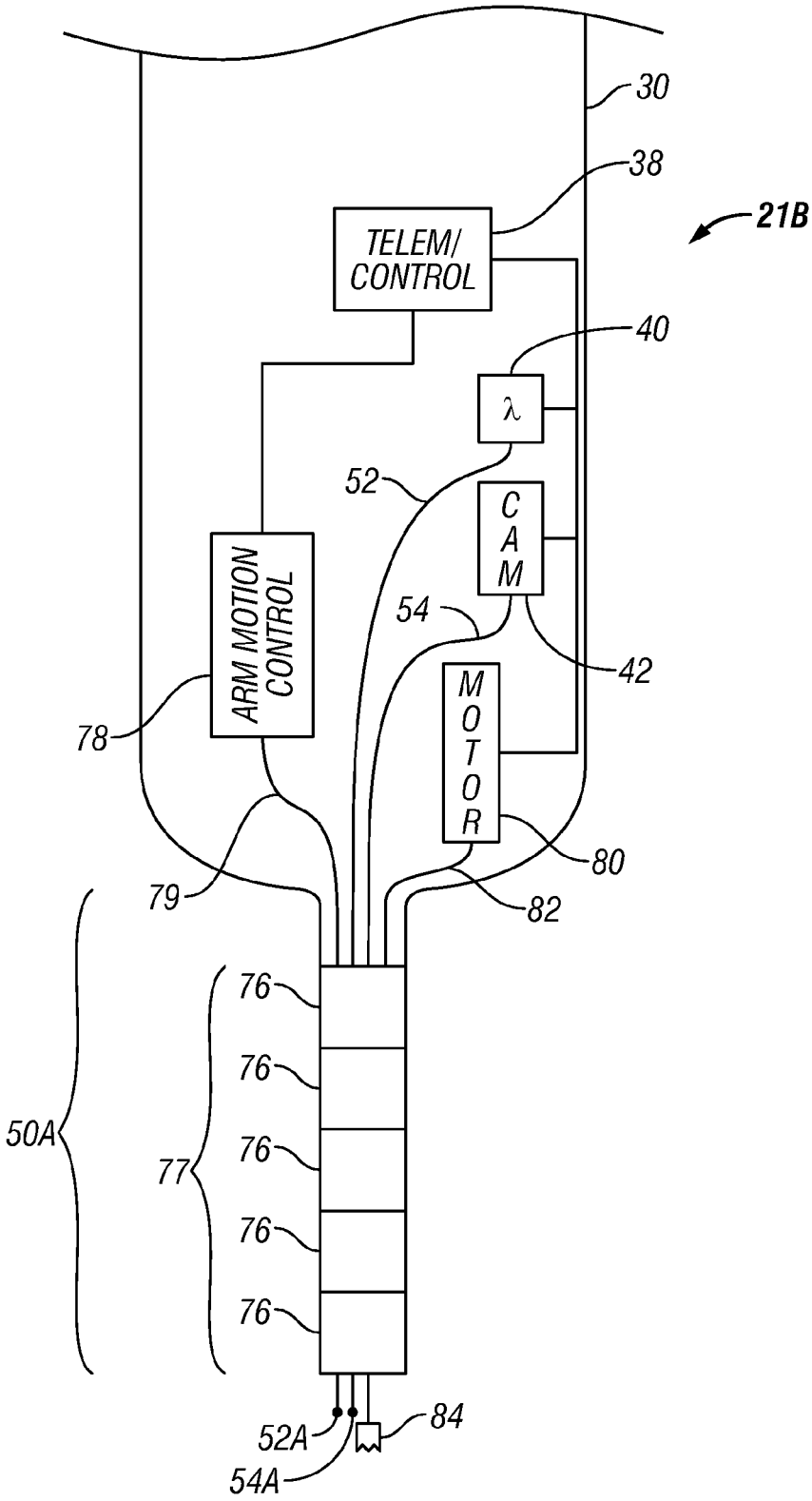
FIG. 5 shows an alternative example of a probe on the tool string of FIG. 3.

An alternative example of a prove shown in FIG. 5 may enable well intervention operations, such as milling, in addition to optical inspection. The probe 50A may include an articulated, robotically controlled arm 77 extending from the lower end of the housing 30. The lower end of the arm 77 may include the light source output lens 52A, the video input lens 54A and a mill or similar tool 84 ("probe mill"). In the present example, the light and video are conducted to the light source 40 and camera 42 over respective optical fibers 52, 54, just as in the example shown in FIG. 3. The probe mill 84 may be rotationally coupled to a motor 80 in the housing 30 using a flexible shaft 82 or the like. The motor 80, light source 40, and camera 42 may be controlled by the controller 38 just as in the example shown in FIG. 3. The arm 77 may consist of a plurality of longitudinally connected arm segments 76 each able to have its longitudinal axis bent with respect to the longitudinal axis of the adjacent segment 76. Movement of the axes of a plurality of segments 76 may enable the bottom end of the arm 77 to be bent to subtend any angle with respect to the longitudinal axis of the housing 30. Such bending motion may be provided by an arm motion controller 78.

In using the probe 50A of FIG. 5, the instrument 21B may be moved to a position in the pipe string (18 in FIG. 1) such that at least the probe 50A extends below the bottom of the mill (16 in FIG. 1). The shoes (72 in FIG. 4) may be moved to fix the axial position of the instrument 21B. The probe 50A may be bent to optically inspect the cutting surface of the mill (16 in FIG. 1) or, for example, to inspect a window (not shown) cut in the casing by the mill for a lateral wellbore. In the latter case, if the optical inspection indicates a fault in the milled window, the arm 77 may be bent to place the probe mill 84 in contact with the part of the window (not shown) requiring intervention. The motor 80 may be actuated to rotate the probe mill 84, thus enabling further dress milling of the window (not shown). The probe mill 84 may also be used to mill minor defects in the irregular surface (14 in FIG. 1) to avoid resuming milling operations with the mill (16 in FIG. 1).

The probe 50A shown in FIG. 5 does not include the sheath (58 in FIG. 3), however, in some implementations of such probe 50A, a sheath or similar device may be provided. Further, the instrument 21B as shown in FIG. 5 may omit the reservoir (46 in FIG. 3) and associated components for ejecting a pill of optically transparent fluid. In such examples, a pill of optically transparent fluid may be moved through the pipe string (18 in FIG. 1) from the Earth's surface to the depth position of the instrument 21B in the wellbore (10 in FIG. 1).

Figure 6:
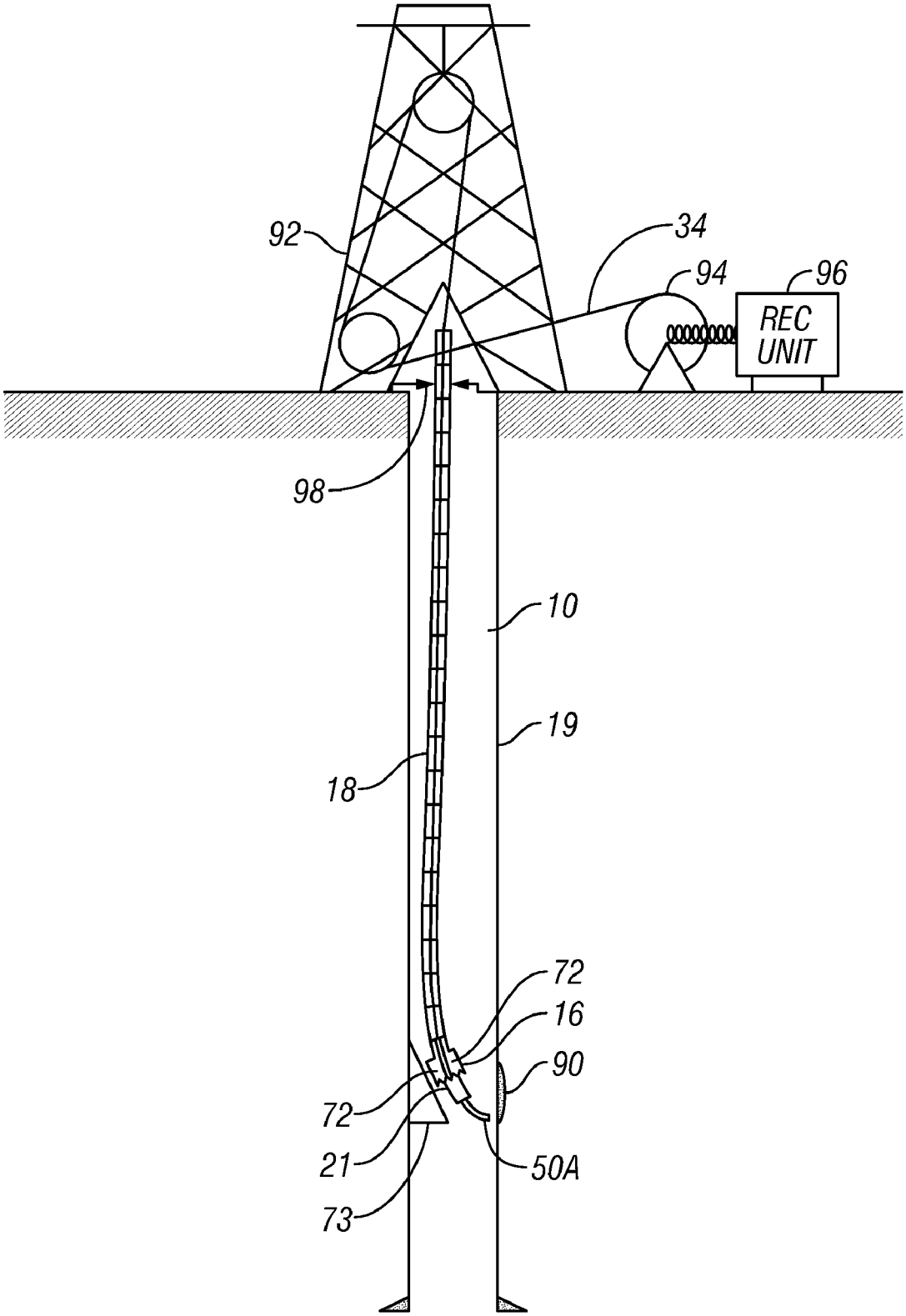
FIG. 6 shows one example of using a device according to the invention.

FIG. 6 shows an example of using a device such as shown in FIG. 5. A pipe string 18 is shown disposed in a wellbore 10 having a casing 19 cemented therein. The pipe string 18 cooperates with a whipstock 73 or similar deflection device so that a mill 16 at the lower end of the pipe string 18 can mill a window 90 in the wall of the casing 19 for drilling of a lateral well. The pipe string 18 is suspended by slips 98 coupled to the drill floor of a drilling rig 92. The pipe string 18 is suspended so that there is a gap below the bottom of the mill 16 for release of at least part of the instrument 21 through a port in the mill 16 (as explained with reference to FIG. 1A and FIG. 1). The instrument 21 is extended into and withdrawn from the interior of the pipe string 18 by a winch 94 having a wireline 34 thereon. The wireline 34 is electrically coupled to devices in a recording unit 96. The devices (not shown separately) in the recording unit 96 can generate commands to operate the various devices in the instrument 21 (see e.g. FIG. 3 and FIG. 5) and can receive signals from the camera (42 in FIG. 3) for observation and interpretation. The instrument 21 is shown with the shoes 72 deployed to fix the axial position of the instrument 21. The probe 50A is shown deployed with its lower end proximate the window 90. In the present example, a pill of transparent fluid may be pumped through the pipe string 18 until it is disposed in the casing 19 proximate the window 90. An optical inspection of the window 90 may be made. Any portions of the window 90 that may not be suitably formed, for example, for insertion of a sealing lateral junction (not shown) may be dress milled using the probe mill (84 in FIG. 5). Reinspection may be performed after milling with the probe mill.

Examples of an inspection and/or intervention apparatus and methods according to the various aspects of the invention may provide the ability to optically inspect and further work components of a wellbore without the need to remove a working pipe string from the wellbore. Such ability may reduce the need to "trip" pipe into and out of a wellbore, saving valuable drilling rig and/or workover rig operating time. The inspection and/or intervention device of the invention may also be deployed by a smaller outside diameter pipe string run inside a previously run, larger inside diameter conduit where the proposed equipment needs to be inspected and evaluated.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore optical inspection instrument, comprising:

a housing configured to move along the interior of a pipe string disposed in a wellbore, the pipe string having a cutting structure at a bottom end thereof;

a probe extending from a bottom longitudinal end of the housing, the probe having therein an output from a light source and a light input to a video camera, wherein the probe has a diameter selected to enable extension thereof through an opening in the cutting structure.

2. The instrument of claim 1 wherein the cutting structure is a mill.

3. The instrument of claim 1 wherein the opening includes a closure element releasably inserted therein.

4. The instrument of claim 3 wherein the housing includes a releasing tool at a lower end thereof configured to release the closure element.

5. The instrument of claim 1 wherein the housing includes a cable head at an upper longitudinal end thereof, the cable head configured to make electrical and mechanical connection to a wireline.

6. The instrument of claim 1 further comprising a reservoir disposed in the housing having optically transparent fluid therein, and means for discharging the fluid proximate a lower end of the probe thereby enabling optical inspection proximate an end of the probe.

7. The instrument of claim 6 further comprising a sheath radially surrounding the probe, the sheath having length and diameter selected to minimize a volume of the transparent fluid needed to enable optical inspection.

8. The instrument of claim 1 wherein the probe is disposed in an articulated arm, and wherein the instrument further comprises means for bending the arm to a selected bend with respect to a longitudinal axis of the housing.

9. The instrument of claim 8 further comprising a cutting tool disposed at a lower end of the probe, and a motor functionally associated with the cutting tool.

10. The instrument of claim 9 wherein the motor is rotationally coupled to the cutting tool by a flexible shaft.

11. The instrument of claim 1 wherein the light source and the video camera are disposed in the housing, and wherein the light source is coupled to the output and the video camera is coupled to the input by a respective optical fiber.

12. A method for inspecting a wellbore, comprising:

moving an inspection instrument through an interior of a pipe string inserted into the wellbore, the pipe string having a cutting tool at a lower end thereof;

moving at least part of a probe extending from a bottom longitudinal end of the instrument longitudinally outside the bottom end of the pipe string through a port in the cutting tool;

moving optically transparent fluid into the wellbore proximate an end of the instrument outside the pipe string; and optically inspecting at least one object proximate the optically transparent fluid.

13. The method of claim 12 wherein the moving the instrument outside the pipe string comprises removing a closure element from a passage in the cutting tool.

14. The method of claim 12 wherein the optically inspecting comprises illuminating the at least one object and conducting reflected light therefrom to a video camera.

15. The method of claim 14 wherein the illuminating and conducting comprises placing a lower end of a probe extending beyond a lower end of the instrument into proximity with the at least one object.

16. The method of claim 15 further comprising bending the probe to a selected angle and optically inspecting at least one object disposed away from a longitudinal axis of the instrument.

17. The method of claim 12 further comprising operating a cutting element disposed in a probe extending beyond a lower end of the instrument into the wellbore and affecting a surface of at least one object with the cutting element.

18. The method of claim 12 further comprising maintaining a longitudinal position of the instrument in the wellbore.

19. The method of claim 18 wherein the maintaining comprises extending at least one shoe from the instrument into frictional contact with the wellbore.

20. The method of claim 12 further comprising maintaining a longitudinal position of the instrument in the pipe string.

21. The method of claim 18 wherein the maintaining comprises extending at least one shoe from the instrument into frictional contact with the pipe string.

22. The method of claim 12 wherein the moving the optically transparent fluid comprises discharging the fluid from a reservoir in the instrument.

23. The method of claim 12 wherein the at least one object comprises a casing window.

24. The method of claim 12 wherein the at least one object comprises a pipe segment.

* * * * *